US010151142B2

(12) United States Patent
Lin

(10) Patent No.: US 10,151,142 B2
(45) Date of Patent: Dec. 11, 2018

(54) ROLL-UP WINDOW COVERING HAVING AN ADJUSTABLE LOWER ELEMENT TO FACILITATE CORDLESS HEIGHT ADJUSTMENT

(71) Applicant: Whole Space Industries LTD, Taipei (TW)

(72) Inventor: Tzu-Yen Lin, Taipei (TW)

(73) Assignee: Whole Space Industries LTD, Taipei (TW)

( * ) Notice: Subject to any disclaimer, the term of this patent is extended or adjusted under 35 U.S.C. 154(b) by 124 days.

(21) Appl. No.: 15/403,426

(22) Filed: Jan. 11, 2017

(65) Prior Publication Data

US 2017/0218702 A1 Aug. 3, 2017

Related U.S. Application Data

(60) Provisional application No. 62/340,031, filed on May 23, 2016, provisional application No. 62/319,858, filed on Apr. 8, 2016, provisional application No. 62/289,569, filed on Feb. 1, 2016.

(51) Int. Cl.

| | |
|---|---|
| ***E06B 9/00*** | (2006.01) |
| ***E06B 9/78*** | (2006.01) |
| ***E06B 9/264*** | (2006.01) |
| ***E06B 9/42*** | (2006.01) |
| ***E06B 9/60*** | (2006.01) |
| ***E06B 9/382*** | (2006.01) |
| ***E06B 9/66*** | (2006.01) |
| ***E06B 9/80*** | (2006.01) |

(52) U.S. Cl.

CPC ..... *E06B 9/78* (2013.01); *E06B 9/264* (2013.01); *E06B 9/382* (2013.01); *E06B 9/42* (2013.01); *E06B 9/60* (2013.01); *E06B 9/66* (2013.01); *E06B 9/80* (2013.01); *E06B 2009/425* (2013.01); *E06B 2009/804* (2013.01)

(58) Field of Classification Search

CPC . E06B 9/42; E06B 9/264; E06B 9/382; E06B 9/78; E06B 9/80; E06B 9/66

USPC ..... 160/245, 293.1

See application file for complete search history.

(56) References Cited

U.S. PATENT DOCUMENTS

| | | | | |
|---|---|---|---|---|
| D102,326 | S | 4/1870 | Shirts | |
| 201,710 | A * | 3/1878 | Shaw | E06B 9/42 160/245 |
| 530,079 | A * | 12/1894 | Bergstresser | A47H 23/04 160/29 |
| 1,042,805 | A * | 10/1912 | Lovell | E06B 9/54 160/100 |
| 1,053,658 | A | 2/1913 | Sinclair | |
| 2,116,237 | A | 5/1938 | Ehlers | |
| 5,913,564 | A * | 6/1999 | Stewart | B60P 3/36 160/120 |
| 5,966,854 | A | 10/1999 | Walsh et al. | |
| 6,834,701 | B2 * | 12/2004 | Colson | E06B 9/262 160/121.1 |

(Continued)

*Primary Examiner* — Beth A Stephan

(74) *Attorney, Agent, or Firm* — Buchanan Ingersoll & Rooney PC

(57) ABSTRACT

A window covering can be configured to facilitate height adjustment of window covering material. In some embodiments, a handle or clips may be utilized to help maintain the position of the window covering material so that the use of an operator cord and/or exposed lift cords can be avoided or minimized.

20 Claims, 9 Drawing Sheets

(56) References Cited

U.S. PATENT DOCUMENTS

| | | | | |
|---|---|---|---|---|
| 6,860,312 | B2 | 3/2005 | Judkins | |
| 7,086,446 | B2 | 8/2006 | Kollman et al. | |
| 8,186,412 | B2 | 5/2012 | Lin | |
| 9,896,883 | B1 | 2/2018 | Cheng | |
| 2004/0060670 | A1 | 4/2004 | Judkins | |
| 2005/0257902 | A1 | 11/2005 | Pernicano | |
| 2009/0308545 | A1 | 12/2009 | An | |
| 2013/0269885 | A1* | 10/2013 | Cavarec | E06B 9/64 160/311 |
| 2017/0218702 | A1 | 8/2017 | Lin | |

* cited by examiner

ROLL-UP WINDOW COVERING HAVING AN ADJUSTABLE LOWER ELEMENT TO FACILITATE CORDLESS HEIGHT ADJUSTMENT

CROSS-REFERENCE TO RELATED APPLICATIONS

This application claims priority to U.S. Provisional Patent Application No. 62/289,569, filed on Feb. 1, 2016, U.S. Provisional Patent Application No. 62/319,858, filed on Apr. 8, 2016, and U.S. Provisional Patent Application No. 62/340,031, filed on May 23, 2016. The entirety of U.S. Provisional Patent Application No. 62/289,569 is incorporated herein by reference. The entirety of U.S. Provisional Patent Application No. 62/319,858 is incorporated herein by reference. The entirety of U.S. Provisional Patent Application No. 62/340,031 is incorporated herein by reference.

FIELD OF THE INVENTION

The present invention relates to window coverings such as roll-up shades, mechanisms for controlling the raising and lower of roll-up shades, and methods of making and using the same.

BACKGROUND OF THE INVENTION

Examples of roll-up shades can be appreciated from U.S. Pat. Nos. 6,860,312 and 7,086,446. Roll-up shades often include a panel of window covering material attached at its top edge to a headrail. Two or more looped lift cords extend from the headrail down a front face of the panel of window covering material, around the bottom edge of the panel and up an opposite rear face of the panel of window covering material into the headrail. The lift cords may then pass through a cord lock in the headrail or wind around a cord collector within the headrail that is coupled to a spring motor, electric motor, or a loop cord drive. Movement of the lift cords into the headrail can cause the panel of window covering material to roll-up as the window covering material is raised and movement of the lift cords out of the headrail can cause the window covering material to unroll as it is lowered. The looped lift cords are spaced apart from one another. The number of looped lift cords can typically depend upon the width of the window covering material but most, if not all, conventional roll-up shades have at least two looped lift cords.

In recent years there has been an increased concern in the window covering industry about child safety as it relates to exposed cords. For instance, there have been instances involving some types of blinds in which a child's head and neck have become entangled in a cord loop that is used to raise and lower the blind. Roll-up shades often have looped lift cords in which the panel of window covering material is captured. Some have observed that the exposed looped lift cords in a conventional roll-up shade could pose the same danger as lift cord loops that are can be formed in connection with other types of blinds such as a venetian blind.

SUMMARY OF THE INVENTION

I have determined that a new mechanism is needed to provide a means by which window covering material can be rolled up for raising of a window covering and unrolled for lowering of a window covering. A new window covering is provided and a new method of adjusting a position of window covering material of a window covering is also provided. Some embodiments of the window covering can be configured as a cordless roll-up shade. Embodiments of the window covering can be configured so that the unrolling, or lowering, of the window covering material as well as the rolling up, or raising, of the window covering material can occur without the use of any exposed lift cords so that lift cord entanglements can be avoided. In some embodiments, the window covering can be configured so that the window covering can be made for a relatively low cost by not including any lift cords and not including a spring motor, electric motor, loop cord drive, or other type of lift cord control mechanism coupled to such lift cords for controlling the positioning of window covering material.

In some embodiments, a window covering can include a first rail and window covering material that is connected to the first rail such that the window covering material is moveable between a first position (e.g. a fully extended position or a substantially extended position) and a second position (e.g. a retracted position or a substantially retracted position). A first lower portion of the window covering material and a second portion of the window covering material can be rolled up when the window covering material is in the second position (e.g. a fully retracted position or a partially retracted position). A third portion of the window covering material may be located above the first and second portions of the window covering material when the window covering material is in the second position. A first clip can be attachable to the window covering material to extend between the third portion of the window covering material and one of the first portion of the window covering material and the second portion of the window covering material when the window covering material is in the second position to maintain the window covering material in the second position. The first clip can be removable from at least the third portion of the window covering material to facilitate adjustment of the window covering material from the second position to a third position that is located between the first and second positions. The first portion of the window covering material can be rolled up when the window covering material is in the third position (e.g. a position between the first and second positions). The first clip can be reattachable to the window covering material such that the first clip extends between the first portion of the window covering material and an unrolled portion of the window covering material that is above the first portion to engage the window covering material to maintain the window covering material in the third position.

In some embodiments, the unrolled portion of the window covering material that is above the first portion when the window covering material is in the third position can be the second portion of the window covering material. In other embodiments, that unrolled portion could be some other segment of the formerly rolled up window covering material that was unrolled upon lowering of the window covering material.

The rolled up portion of the window covering material may be a portion of the window covering material that is rolled about a bottom rail connected to the bottom of the window covering material or that is rolled about a bottom side of the window covering material. The rolling up of the window covering material may result in the window covering material rolling up into a roll having a diameter or width that increases as the window covering material is raised to a fully retracted position as window covering material is rolled about itself upon multiple revolutions to form the bottom rolled up portion as the window covering material is retracted, or raised. The fully retracted position could also be considered a fully raised position or a fully open position.

In some embodiments, when the window covering material is in a fully extended position, there may not be any portion of the window covering material rolled up. In other embodiments, the window covering can be configured so that when the window covering is fully extended a bottom portion of the window covering material is still rolled up. The fully extended position could also be considered a closed position or a fully lowered position. It should be appreciated that the window covering material of the bottom rolled up portion that is formed when the window covering material is moved to the fully retracted position can be unrolled to form a segment of the unrolled portion of the window covering material that is located above the rolled up portion as the window covering material is lowered, or extended, from its fully retracted position. The unrolling of the material can result in the rolled-up portion having a decreasing width, or diameter, as the window covering material is unrolled during lowering, or extension, of the window covering material.

In some embodiments, the window covering can include a first rail and window covering material connected to the first rail such that the window covering material is moveable between a first position and a second position. A first lower portion of the window covering material and a second portion of the window covering material can be rolled up when the window covering material is in the second position. A third portion of the window covering material can be located above the rolled up first and second portions of the window covering material when the window covering material is in the second position. The third portion may be an unrolled portion above the rolled up portion when the window covering material is in the second position. The third and second portions may be unrolled when the window covering material in the first position. The second and third portions of the window covering material may be above the rolled up first portion or may be above an unrolled first portion of the window covering material when the window covering material is in its first position. At least one handle can be connected to a bottom portion of the window covering material. Each handle may be moveable between an engaged position in which the handle engages the window covering material and a disengaged position in which the handle disengages the window covering material to permit movement of the window covering material between the first and second positions of the window covering material. Each handle can be configured to contact the window covering material to engage the window covering material to prevent the window covering material from being rolled up about the bottom portion of the window covering material and to prevent the window covering from being unrolled when in the engaged position. Each handle can be configured to be spaced apart from the window covering material sufficiently to permit the window covering material to be moved between the first and second positions of the window covering material when in the handle is in its disengaged position.

In some embodiments the first position of the window covering material may be a lowered or extended position and the second position may be a raised or retracted position. In some embodiments, the first position may be a fully extended or fully lowered position and the second position may be a fully raised or fully retracted position.

The handle can be linearly moveable between the engaged and disengaged positions or may be rotatable between the engaged and disengaged positions. In some embodiments, the handle can be rotatably and linearly moveably between its engaged and disengaged positions. In some embodiments, the handle may have its opposite ends moveably coupled to opposite ends of a second rail that is coupled to the bottom of the window covering material to connect the handle to the window covering material. For instance, the handle can have a first end slideably and/or rotatably connected to a first end of a bottom rail and the second end can be slidably and/or rotatably connected to a second end of the bottom rail. In other embodiments, there may be a first handle coupled moveably coupled to the first end of the second rail and a second handle moveably coupled to the second end of the second rail. Each handle can be moveable linearly and/or rotatably between engaged and disengaged positions. In the engaged positions, the handles may contact the rolled up portion of window covering material and/or other portion of the window covering material to maintain the position of the window covering material. In the disengaged positions the handles may be spaced apart from the window covering material to permit the material to be further rolled up or to be unrolled for adjustment of the position of the window covering material.

In some embodiments, the window covering material may be configured to have loops, rings, or connectors and each handle has one or more hooks or clips configured to connect to the loops, rings or connectors when the handle is in the engaged position.

The handle can have a length that extends between a first end of the handle and a second end of the handle. The length of the handle can contact the width of the window covering material when the handle is in the engaged position.

A window covering can also be configured to include a first rail and window covering material having a top portion connected to the first rail such that the window covering material is moveable between a first position and a second position. A first lower portion of the window covering material and a second portion of the window covering material can be rolled up when the window covering material is in the second position. A third portion of the window covering material can be located above the first and second portions of the window covering material when the window covering material is in the second position. The first, second, and third portions of the window covering material may be located below the top portion of the window covering material. A second rail can be connected to a bottom portion of the window covering material. The second rail can have a spring positioned at least partially therein that is adjustable from an engaged position to a disengaged position. The spring can be connected to the second rail to drive rotation of the second rail to facilitate rolling up of the window covering material about the second rail when the spring is in the engaged position. A handle can be connected to the second rail such that the handle is moveable between a first position and a second position. The handle can be connected to the spring such that movement of the handle from its first position to its second position adjusts the spring from the disengaged position to the engaged position and movement of the handle form the second position of the handle to the first position of the handle adjusts the spring from the engaged position to the disengaged position.

The bottom portion of the window covering material can be located such that the first, second, and third portions of the window covering material are between the top and bottom portions of the window covering material when the window covering material is fully extended, or fully lowered. It should be understood that, in some embodiments, during rolling up of the window covering material as the window covering is adjusted to a raised position, the outer portions of the rolled up portion of the window covering material may be positioned lower than the bottom portion of the window covering material.

A plurality of clips can be connected to the handle. The clips can be configured to extend from the handle to releaseably connect to the window covering material to maintain the window covering material in the second position when the clips are connected to the window covering material and to permit adjustment of the window covering material when the clips are disconnected from the window covering material. The clips can be configured to be releaseably connectable to connectors of the window covering material to be releaseably connected to the window covering material. In some embodiments, the connectors may be rings or loops attached to the window covering material via elongated members so that there are at least two columns of spaced apart connectors for coupling to at least two clips that extend form the second rail or are moveably connected to the second rail.

A window covering is also provided that includes a first rail and window covering material. The window covering material can have a top portion connected to the first rail such that the window covering material is moveable between a first position and a second position. A first lower portion of the window covering material and a second portion of the window covering material can be rolled up when the window covering material is in the second position. A third portion of the window covering material can be located above the first and second portions of the window covering material when the window covering material is in the second position. The window covering can also include a first column of connectors connected to the window covering material, a second rail connected to a bottom portion of the window covering material, and a first handle connected to a first end of the second rail, the first handle being moveable between a first position and a second position. A portion of the first handle can be configured to be releaseably connected to the window covering material via a connector of the first column of connectors when the first handle is in the first position of the first handle to help maintain a position of the window covering material and the portion of the first handle can be separated from the connector of the first column of connectors when the first handle is in the second position of the first handle to facilitate adjustment of the window covering material. Embodiments of the window covering can also include a second handle connected to a second end of the second rail that is opposite the first end of the second rail. The second handle can be moveable between a first position and a second position. A portion of the second handle can be configured to be releaseably connected to the window covering material via a connector of the second column of connectors when the second handle is in the first position of the second handle to help maintain a position of the window covering material and the portion of the second handle can be separated from the connector of the second column of connectors when the second handle is in the second position of the second handle to facilitate adjustment of the window covering material.

Embodiments of the window covering can also include a spring positioned within the second rail. The spring can be actuatable between an engaged position and a disengaged position. The spring can bias rotation of the second rail when the spring is in the engaged position. The first handle can be configured to actuate adjustment of the spring from the disengaged position to the engaged position when the first handle is moved from the first position of the first handle to the second position of the first handle. The second handle can also (or alternatively) be configured to actuate adjustment of the spring from the disengaged position to the engaged position when the second handle is moved from the first position of the second handle to the second position of the second handle.

Other details, objects, and advantages of the window covering and method will become apparent as the following description of certain exemplary embodiments thereof proceeds.

BRIEF DESCRIPTION OF THE DRAWINGS

Exemplary embodiments of the window covering and methods of making the same are shown in the accompanying drawings. It should be understood that like reference numbers used in the drawings may identify like components.

DETAILED DESCRIPTION OF EXEMPLARY EMBODIMENTS

Figure 1:
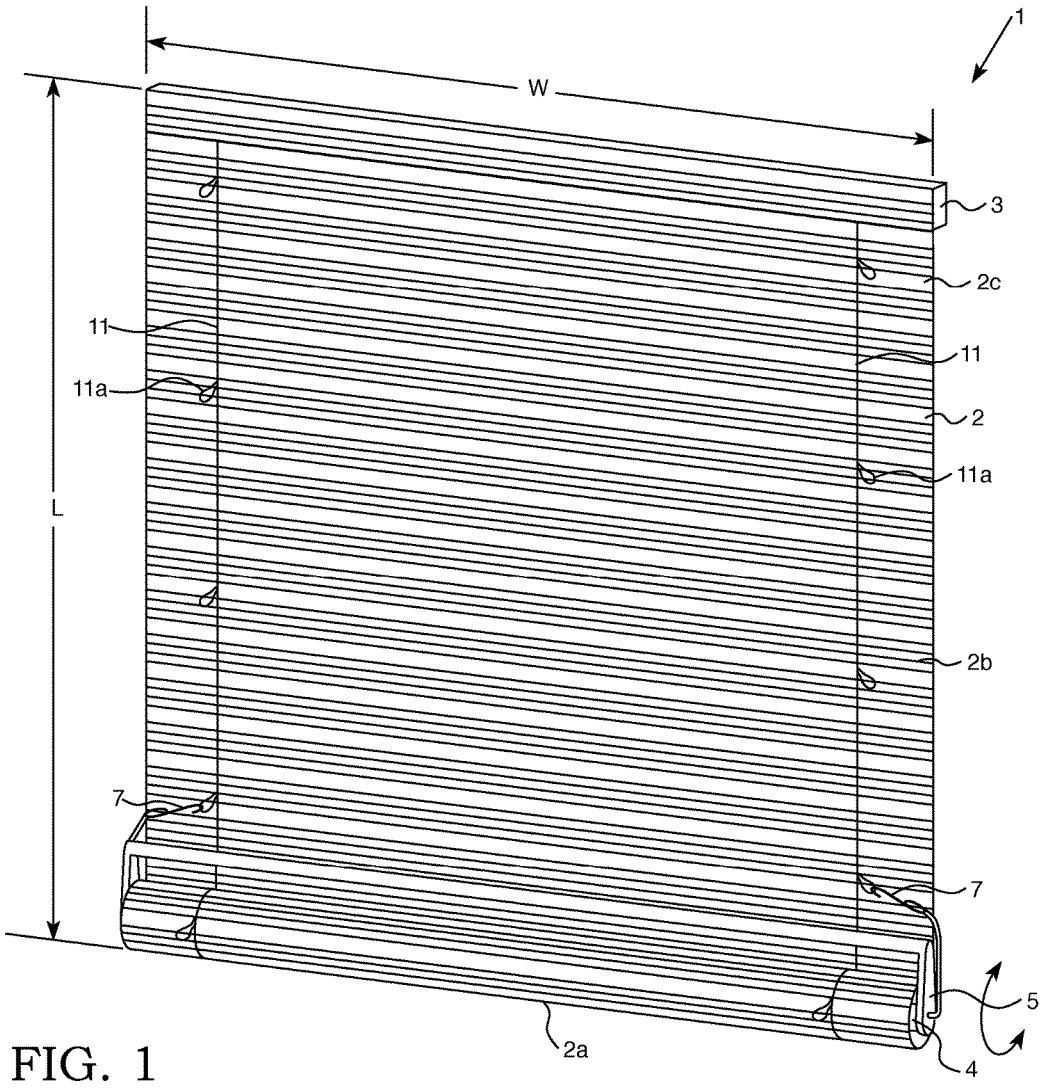
FIG. 1 is a perspective view of a first exemplary embodiment of my window covering in a first position.
Figure 2:
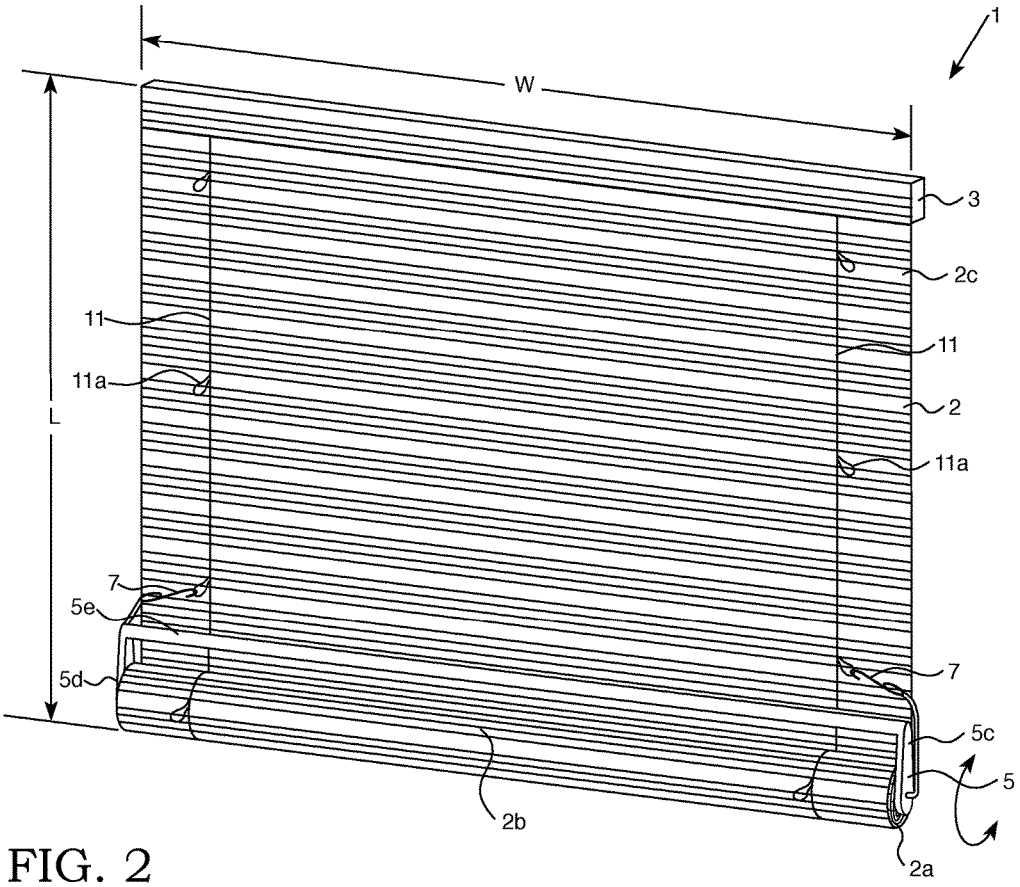
FIG. 2 is a perspective view of a first exemplary embodiment of my window covering in a second position.
Figure 3:
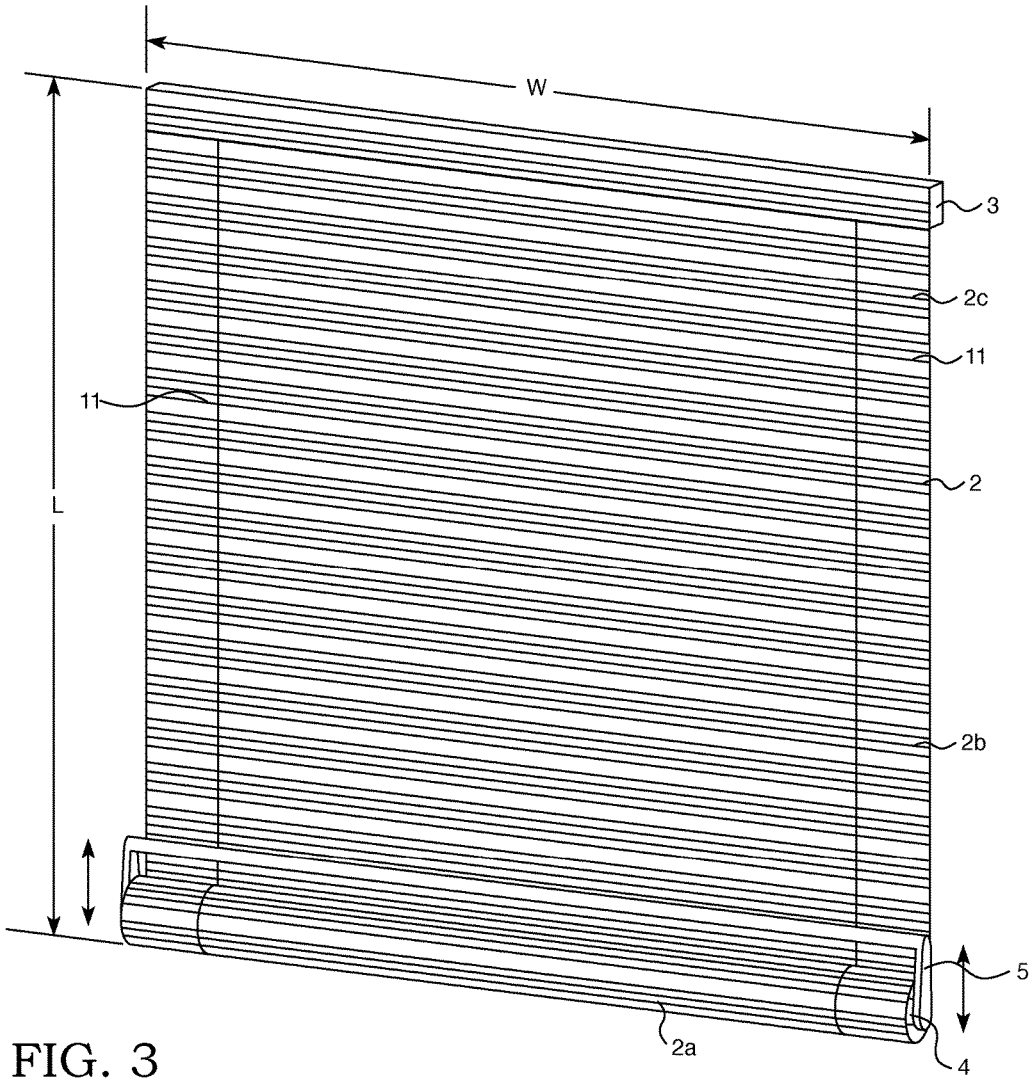
FIG. 3 is a perspective view of a second exemplary embodiment of my window covering in a first position.
Figure 4:
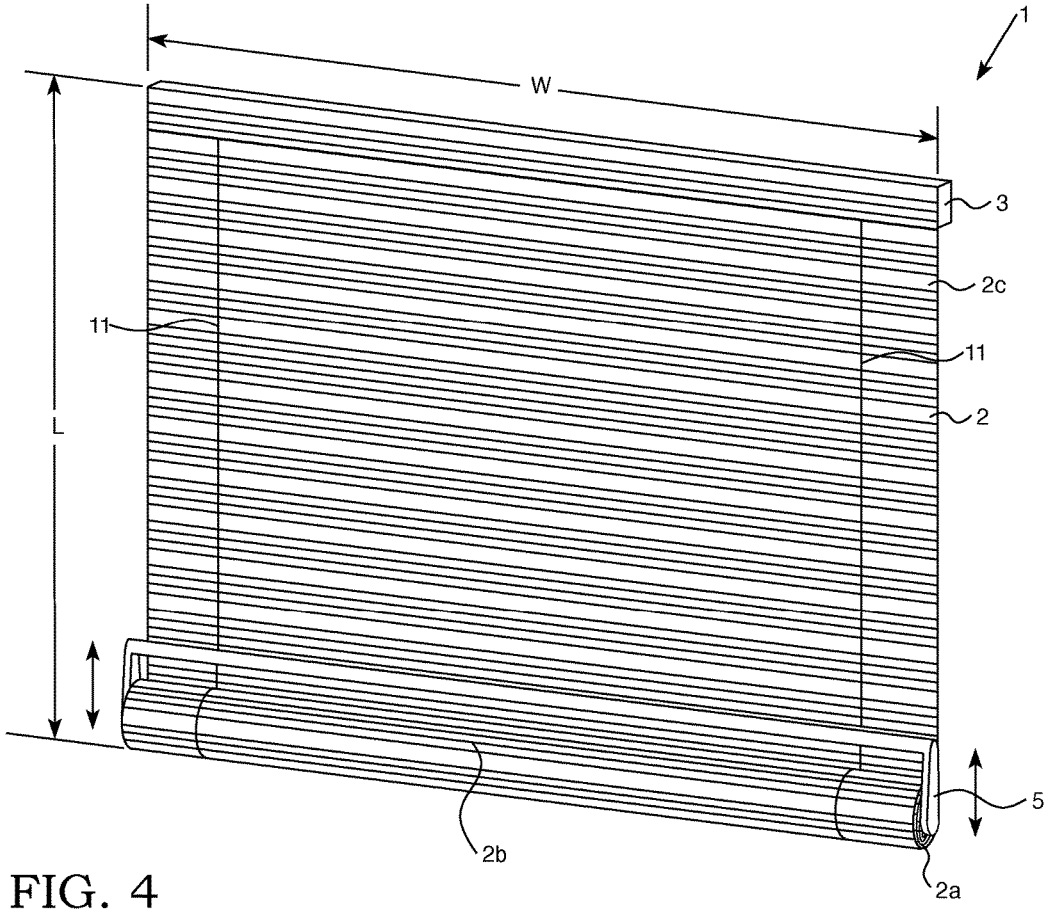
FIG. 4 is a perspective view of a second exemplary embodiment of my window covering in a second position

As can be appreciated from FIGS. 1-10, embodiments of the window covering can include a height adjustment mechanism for controlling the raising and lowering of window covering material that permits the window covering material to be raised and lowered without use of lift cords passing through a cord lock and/or without use of any lift cords. In some embodiments, the window covering can be configured as a roll-up shade.

For instance, the window covering 1 can have window covering material 2 that extends from a first rail 3. A top portion of the window covering material may be connected to the first rail. A bottom portion of the window covering material 2 may be connected to a second rail 4. The first rail 3 may be a headrail or the intermediate rail of a top down bottom up shade. The second rail 4 may be a bottom rail. In some embodiments, it is contemplated that the second rail 4 may not be present.

The window covering material 2 can be moveable from a first position to a second position and may also be moveable to a number of other positions that may be located between the first and second positions. For instance, the window covering material 2 can be configured to be moveable between a fully extended position or a fully lowered position to a fully retracted position or a fully raised position and may also be moved to other positioned between the fully lowered and fully raised positions.

The window covering material 2 can be composed of any number of suitable materials, such as fabric, woven wood, woven bamboo, woven together polymeric slats (e.g. polyvinyl chloride ("PVC") slats, etc.), or other type of window covering material. The width W of the window covering material may extend from a first side of the window covering material to a second opposite side of the window covering material. The first and second sides may extend along the length L of the window covering material from a top of the window covering material located adjacent the first rail 3 to a bottom of the window covering material located adjacent the second rail 4. The first rail 3 can be structured as a shaft, tube, bar, or other elongated member composed of metal, polymeric material, wood, or other type of material. The second rail 4 can also be structured as a shaft, tube, bar, or other type of elongated member composed of metal, polymeric material, wood, or other type of material.

The window covering material 2 can include a first portion 2*a*, a second portion 2*b*, and a third portion 2*c*. The third portion 2*c* may be located adjacent the first rail, the second portion 2*b* can be positioned between the first and third portions 2*a* and 2*c*. The first portion 2*a* can be the bottom portion of the window covering material. The window covering material 2 can be coupled to the first rail 3 such that when the window covering material 2 is raised, the first portion 2*a* of the window covering material rolls up about the second rail 4 or about the bottom of the window covering material. The second portion 2*b* can also be rolled up as the window covering material is moved from its fully extended position to a retracted position. The third portion 2*c* may be located above the rolled up portion as the window covering material is rolled up during raising of the window covering material. When the window covering material 2 is lowered, the second portion 2*b* and/or first portion 2*a* may be unrolled. In some partially extended or partially retracted positions of the window covering material 2, the first portion 2*a* may be rolled up while the second portion 2*b* and the third portion 2*c* is unrolled and located above the rolled up portion of the window covering material. Some embodiments may be configured so that when the window covering material is in a fully extended position, the first portion 2*a* may be unrolled. Other embodiments can be configured so that when the window covering material is at a fully extended position the first portion 2*a* may still be in a rolled up position.

The window covering material 2 can include a plurality of elongated members 11 that extend from the top of the window covering material 2 adjacent the first rail 3 to the bottom of the window covering material adjacent the second rail 4. The elongated members may be flexible members such as cords, polymeric filaments, or other types of elongated flexible elements. The elongated members 11 can include spaced apart connectors 11*a*, such as loops, rings, or other type of connectors. The connectors 11*a* can be coupled to the elongated members to form columns of connectors along the length L of the window covering material 2. The connectors 11*a* in each of the columns may be spaced apart from the other connectors in that column along the length L of the window covering material. Connectors 11*a* in one column of connectors 11*a* can be positioned to be parallel to corresponding connectors 11*a* of other columns of connectors 11*a*. For instance, a first column of spaced apart connectors 11*a* can be located adjacent the first side of the window covering material 2 and a second column of spaced apart connectors can be located adjacent the second side of the window covering material 2. Connectors of the first column can be positioned so that each connector 11*a* is at a location along the length L of the window covering material that is aligned with a corresponding connector 11*a* of the second column of connectors. It is contemplated that there may be other columns of spaced apart connectors 11*a* attached to other elongated members 11 between the first and second columns located adjacent the first and second sides of the window covering material 2.

The second rail 4 can include a spring arrangement, such as a roller spring arrangement, a coil spring arrangement that is coupled to a clutch 33 within a channel or cavity of the second rail, or another type of spring arrangement that is configured to bias the second rail 4 to rotate to facilitate rolling up of the window covering material during raising of the window covering material 2. The spring arrangement of the second rail 4 can be configured so that it is adjustable from an engaged position to a disengaged position via clutch or other mechanism so that a biasing force of the spring is only translated to effect rotation of the second rail when it is adjusted to its engaged position. When adjusted to its disengaged position, the spring 30 can be prevented from transferring its biasing force to drive rotation of the second rail 4 for winding or rolling up of the window covering material 2. At least one handle can be connected to the second rail 4 and to the clutch so that motion of the handle actuates motion of the clutch to adjust the clutch 33 to actuate adjustment of the spring between its engaged and disengaged positions. Alternatively, no handle may be needed and a user may just manipulate a bottom portion of the window covering material or the rolled up portion of the material to manipulate the second rail 4 to actuate adjustment of the clutch 33 and the spring 30. For instance, a user can manipulate the bottom portion of window covering material 2 to provide a force for adjusting the clutch 33 to actuate adjustment of the spring 30 between its engaged and disengaged positions by causing the second rail 4 to rotate in a first rotational direction or a second rotational direction to cause the clutch to adjust its position.

In some embodiments, the second rail 4 can be connected to at least one handle 5. For embodiments in which only a single handle 5 is utilized, the handle 5 can be configured to include an elongated member 5*e* that extends along the width W of the window covering material and is spaced apart from the window covering material such that a gap can be presented between the handle 5 and the rolled up portion of window covering material that is present during raising of the window covering material 2. Opposite first and second ends 5*c* and 5*d* of that single handle can be attached to the opposite ends of the second rail 4. At least one end of the single handle may be directly connected to a clutch 33 within the second rail to provide a rotatable and/or linearly moveable connection to clutch 33 for actuating adjustment of a position of the clutch to adjust the position of the spring between the spring's engaged and disengaged positions.

Figure 5:
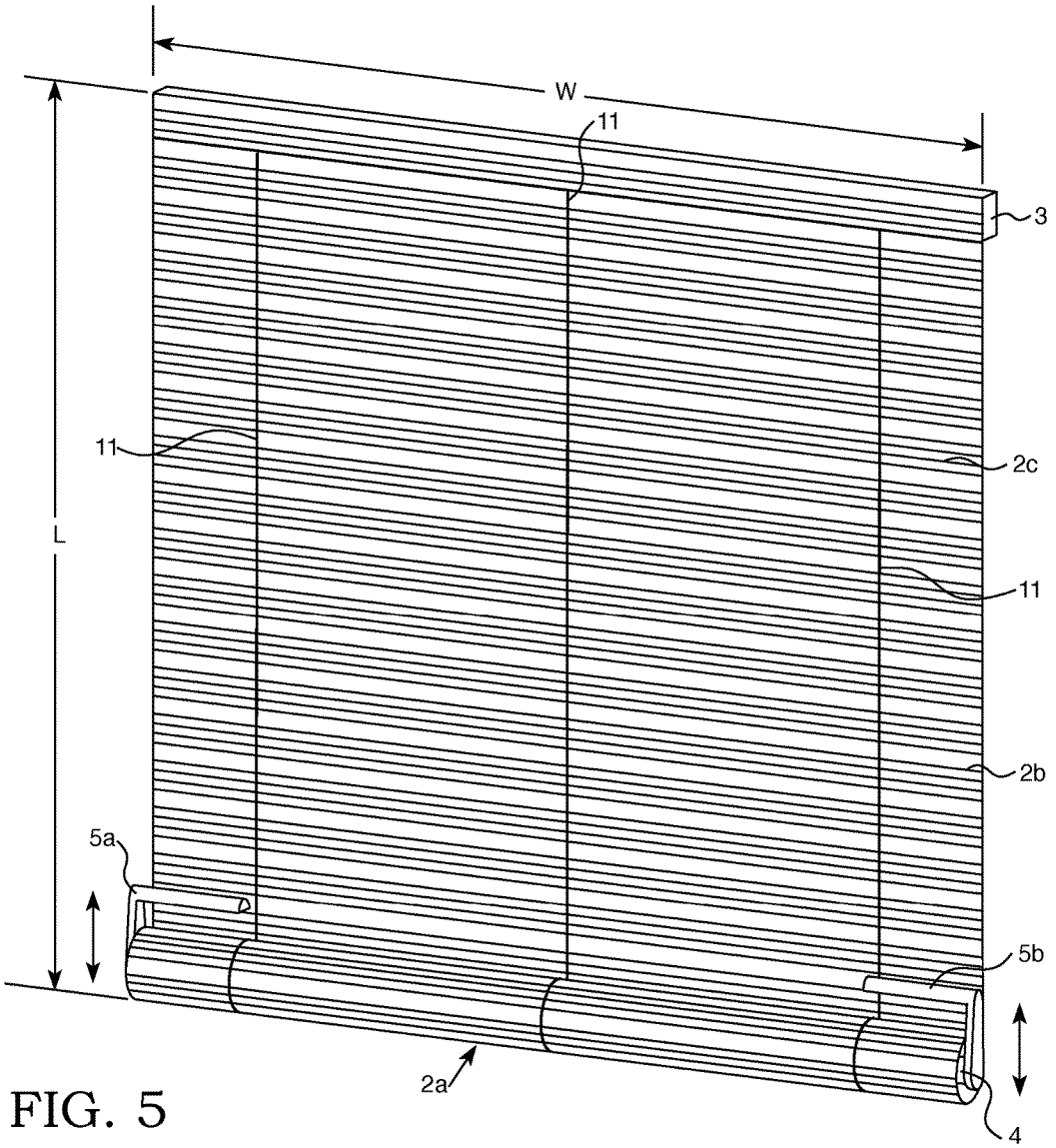
FIG. 5 is a perspective view of a third exemplary embodiment of my window covering in a second position.
Figure 6:
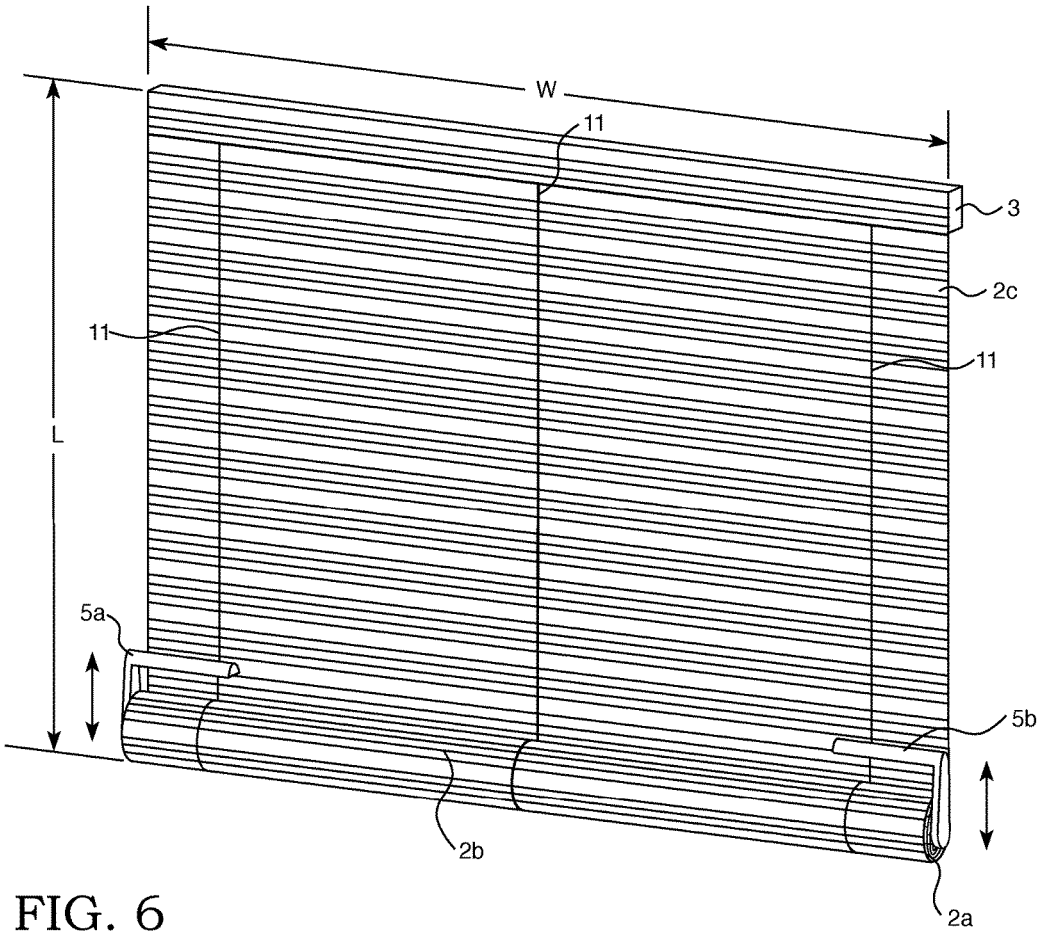
FIG. 6 is a perspective view of a third exemplary embodiment of my window covering in a second position.
Figure 10:
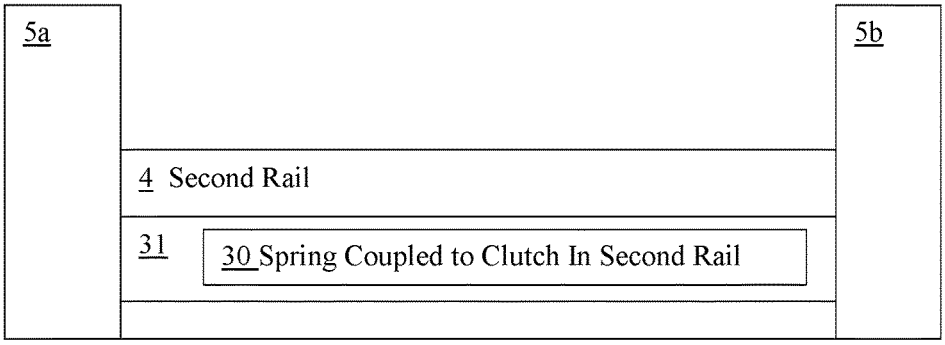
FIG. 10 is a block diagram illustrating a second exemplary handle connection arrangement for linear and/or rotatable connection of the handle to a second rail.

In other embodiments, there may be a first handle 5*a* connected to a first end of the second rail 4 and a second handle 5*b* connected to a second end of the second rail 4 that is opposite the first end of the second rail 4. For instance, each handle may extend from the side of the second rail to which it is attached as shown in FIGS. 5-6 and 10. The handles can be sized to make the handles less visible. For embodiments of the window covering that may utilize a spring 30 coupled to a clutch 31 within the second rail 4, the handles may be positioned to help a user provide a force for actuating adjustment of the position of the clutch 31 for actuating adjustment of the spring 30 between its engaged and disengaged positions while not substantively detracting from the aesthetic effect provided by the window covering material.

Each handle can be coupled to the second rail 4 so that it is rotatable and/or linearly moveable relative to the second rail 4 at the opposite ends of the second rail. The motion of the handle 5 can be configured to actuate adjustment of the spring between its engaged and disengaged positions via a clutch or lock mechanism connected between the handle and the spring. For instance, sliding the handle 5 upwards from a lowermost position to an upper position via linearly moveable connections the handle's opposite ends have to the opposite ends of the second rail 4 can be configured to adjust the spring 30 from its disengaged position to its engaged position. As another example, rotating the handle 5 in a first rotational direction (e.g. clockwise or counterclockwise) via rotatable moveable connections the handle's opposite ends have to the opposite ends of the second rail 4 can be configured to adjust the spring from its disengaged position to its engaged position. A user may use the handle 5 to translate an upward force to adjust the window covering material to raise that material and the activation of the spring can result in effecting a rolling up of the window covering material as the window covering material is raised, or retracted, via motion of the handle in an upwards direction. A user can rotate the handle in an opposite second rotational direction (e.g. a direction that is opposite the first rotational direction) to adjust the handle to its initial first position to cause the spring to adjust to its disengaged position and/or to provide a force for lowering the window covering material to a more extended position such that window covering material unrolls from the rolled up portion as the material is extended, or lowered.

When the user has selected a desired position for the window covering material 2, the user may use clips 7 or another mechanism for maintaining the height of the window covering material at its selected position. For example, a position of the window covering material can be maintained by use of clips 7 that can be attached to the second rail 4 by having the hook ends of the clip connected to or moved into engagement with connectors 11*a*. The clips' connection of the second rail 4 to the window covering material 2 via connectors 11*a* can maintain the position of the second rail 4 and rolled up portion of the window covering material at a desired location. To re-adjust the position of the window covering material, the hook ends of the clips may be decoupled from the connectors 11*a* and the handle 5 may be grasped by a user to provide a force for raising or lowering of the window covering material as previously described herein. Once at its new position, the hook ends of the clips 7 can be recoupled to different connectors 11*a* for maintaining the window covering at the new position.

Instead of utilizing clips 7, at least one handle 5 can be configured for motion to engage the rolled up portion of the window covering material to lock the window covering material in place to keep that material at its selected position. For instance, the handle 5 can be rotated or slideably moved to its lowermost position, or its first position, so its intermediate portion that extends along the width W of the window covering material contacts the rolled up portion of window covering material to engage that material and provide sufficient friction to prevent the rolled up material from unrolling to maintain the position of the window covering material 2. In some embodiments, the entire intermediate portion of the handle can extend along the width W of the window covering material to contact the rolled up portion of the window covering material adjacent to the unrolled portion above the rolled up portion to maintain the position of the window covering material 2. In that position, the handle 5 may also contact the unrolled up portion of the window covering material along the width W of the window covering material.

In other embodiments, it is contemplated that there may be first and second handles 5*a* and 5*b* as shown in FIGS. 5-8 and 10 that are moveable between engaged and disengaged positions. When the handles are in their engaged positions, they can engage the window covering material and/or the rolled up portion of the window covering material to maintain the position of the window covering material via direct contact with the window covering material and/or rolled up portion of the window covering material to provide sufficient friction to prevent unrolling of the rolled up portion of the window covering material. When the handles are in their disengaged positions, they may be out of contact with or otherwise disengaged from the rolled up portion of the window covering material to permit the window covering material to be raised or lowered.

In some embodiments, distal ends of the first and second handles 5*a* and 5*b* can be moveable to pass through a respective connector 11*a* to function as a clip or hook portion to engage the window covering material and maintain the position of the material at a user selected position. For such an embodiment, the distal ends of the handles may also be moveable so they can be moved away from the connectors 11*a* to disengage the window covering material and facilitate height adjustment of the window covering material.

The motion of each handle between its engaged and disengaged positions (e.g. lowermost and upper positions) can be via linear and/or rotational motion relative to the second rail 4. Thereafter, a user may provide a force to rotate or linearly move the handle 5 to a higher position, or a second position, to move the elongated middle portion of the handle 5 out of contact with the rolled up portion of the window covering material 2 to permit height adjustment of the window covering material as discussed herein. Once at the newly selected location, the handle 5 may be returned to its first position to help maintain the window covering material at its new location as discussed herein. In some embodiments, the linear motion of each handle can be provided by a telescoping section of each handle or each end of a single handle that is configured to extend and retract via moveable telescoping segments of the handle. In other embodiments, linear motion of the handle can be effected by a slideable connection or an extendable connection between an upper portion of the handle and a lower portion of the handle that is connected to an end of the second rail 4. A rotational connection between an end of the second rail and an end of the handle attached to that end of the second rail can also, or alternatively, be provided so that the handle is rotatable in first and second rotational directions.

For embodiments of the window covering material in which each handle has a rotational attachment to the second rail 4, the handle can be configured to be rotated to extend below the window covering material. The rotation of the handle can also be configured to permit the handle to be more easily grasped or manipulated by a user. A ball and socket type connection, or other type of rotatable connection mechanism may be utilized to provide the rotatability of the handle.

In some embodiments, the locking of the position of at least one handle in its engaged position may be configured so that the locking is based solely on linear motion of the handle form an extended position to a retracted position. For instance, the handle can be configured so that a significant force from a user that is significantly greater than the force provided by raised shade material being effected by gravity is required to move the handle from its retracted position in which it may engage the window covering material and its extended position in which the handle may be disengaged for the window covering material. Friction between different telescoping segments of the handle may provide this locking feature.

Alternatively, another type of lock mechanism may be coupled to the handle to lock the handle in its engaged position. In some of these alternative embodiments, the rotational connection of the handle to the second rail may not have a substantial role in locking the position of the handle or ensuring the handle stays in engagement with the rolled up portion of window covering material to maintain a position of the window covering when the handle is in its engaged position. In other embodiments, the lock mechanism may lock the handle to prevent its rotational motion to ensure the handle stays engaged with the window covering material and/or the rolled up portion of the window covering material to lock the position of the handle 5 and maintain the position of the window covering material.

Figure 7:
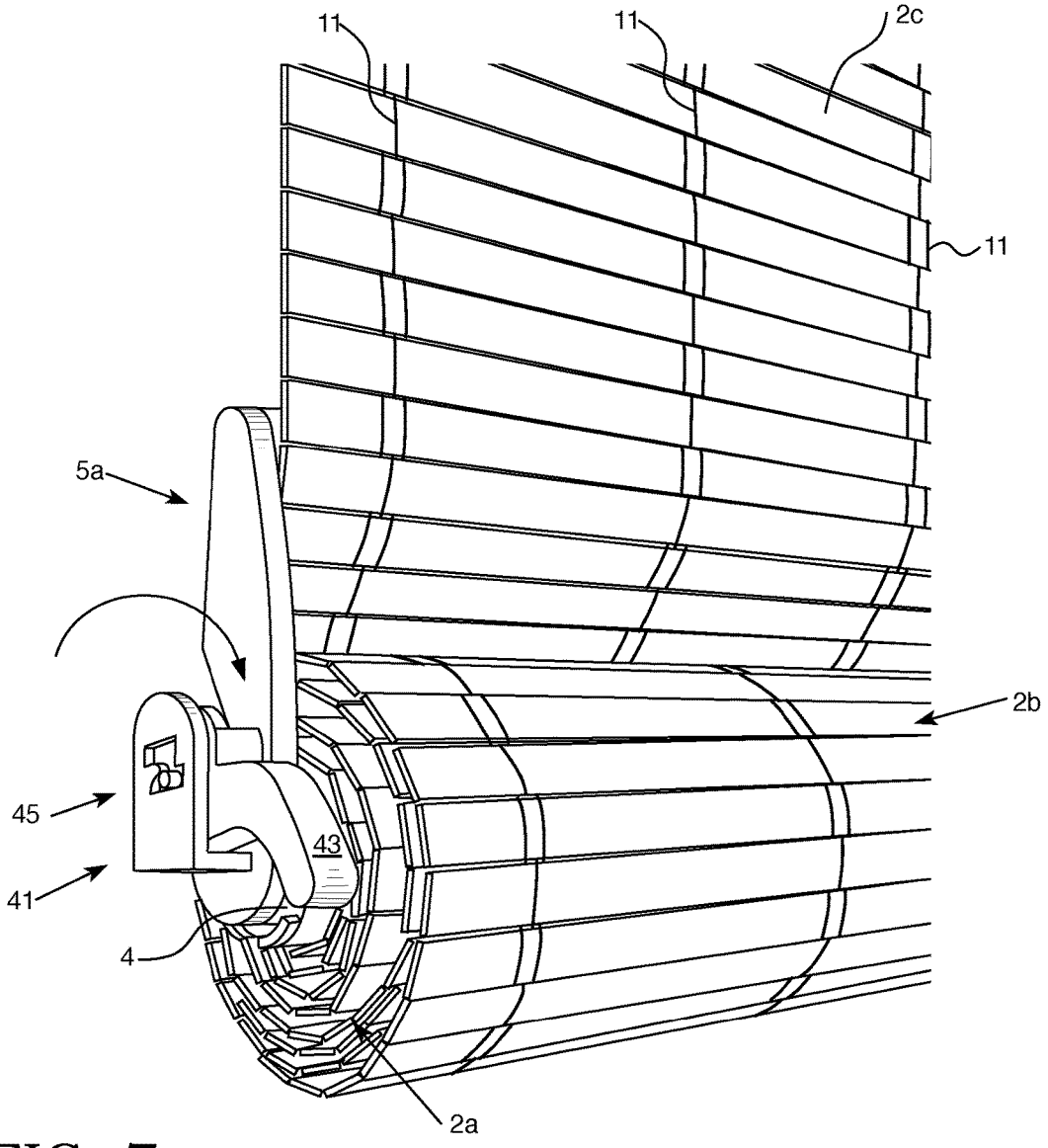
FIG. 7 is a fragmentary side view of an exemplary embodiment of a lock mechanism that is utilizable in embodiments of the window covering with the lock mechanism in a locked position.
Figure 8:
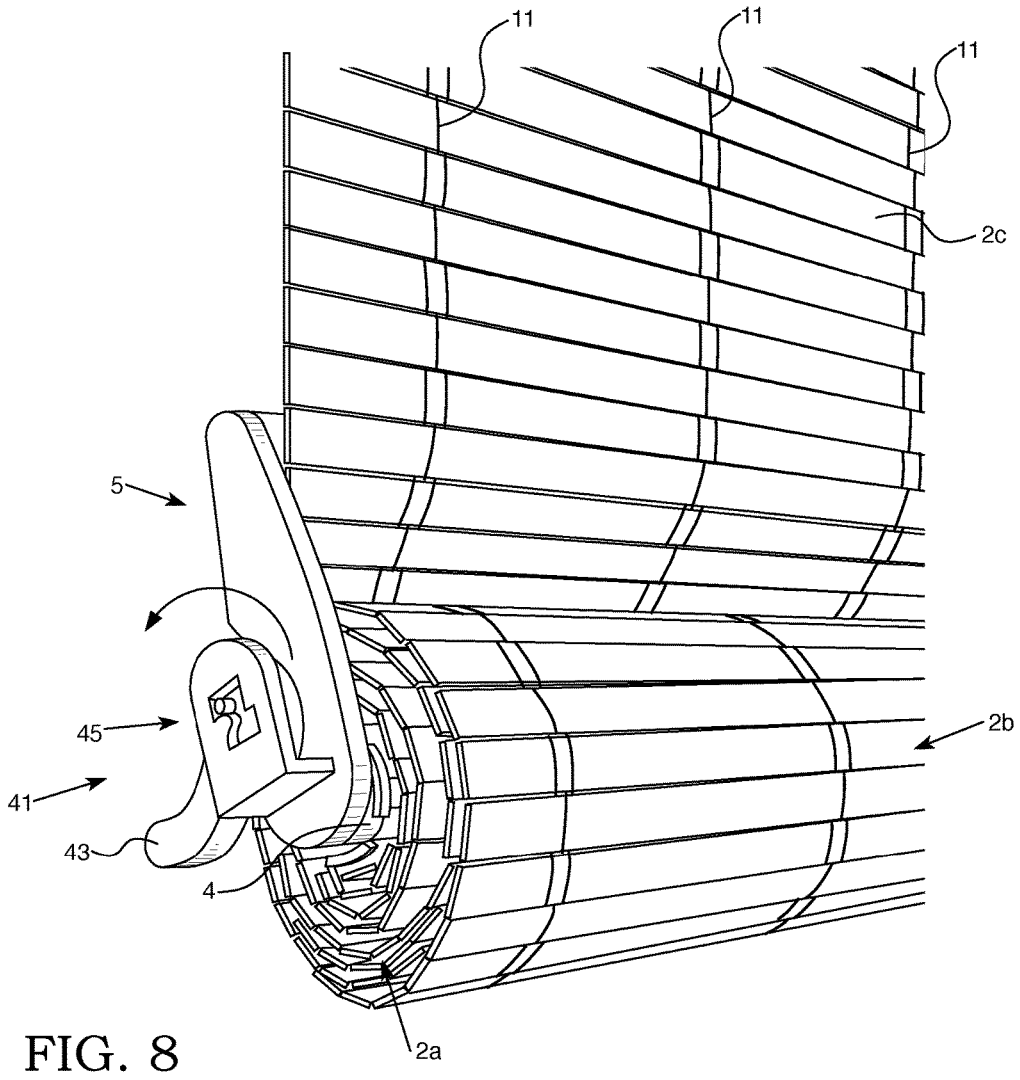
FIG. 8 is a fragmentary side view of an exemplary embodiment of a lock mechanism that is utilizable in embodiments of the window covering with the lock mechanism in an unlocked position.
Figure 9:
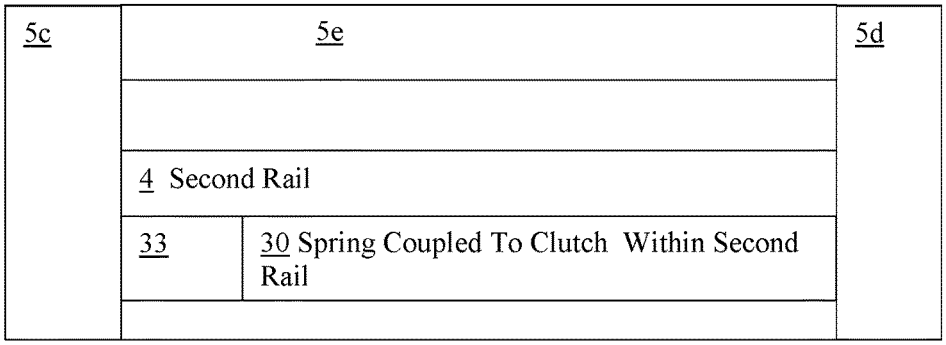
FIG. 9 is a block diagram illustrating a first exemplary handle connection arrangement for rotatable connection of the handle to a second rail.

Referring to FIGS. 7-8, a lock mechanism 41 can be coupled to a handle adjacent its connection to a first end of the second rail 4. In some embodiments, each end of handle 5 may have a lock mechanism 41 attached to that end. In embodiments having spaced apart first and second handles 5*a* and 5*b*, a lock mechanism 41 can be attached to each handle. Each locking mechanism can include an actuator 43 that is moveably attached to the handle 5 so that the actuator 43 can move between first and second positions. A connection between the actuator 43 and a locking element of the lock mechanism 41 can be configured so that motion of the actuator 43 to the first position results in the locking element being caused to move to a locked position to adjust the locking mechanism into a locked position and motion of the actuator 43 to a second position can be configured to cause the locking element to move to an unlocked position to adjust the locking mechanism into an unlocked position. The actuator 43 can be a handle, lever, knob, latch, or other graspable element that is configured so that a user may grasp and manipulate the actuator to adjust the position of the actuator between its first and second positions for locking and unlocking the lock mechanism 41. The actuator 43 can be connected to a housing 45, which may be configured as a bracket or other element for attachment of the actuator 43 to at least one locking element of the lock mechanism 41 and/or the second rail 4 for facilitating the movement of the actuator between its first and second positions and adjustment of the lock mechanism between its locked and unlocked positions. The housing 45 can include one or more of the locking elements that are configured to be movable between locked and unlocked positions to engage a component of the handle or connection of the handle to the second rail 4 for locking the position of the handle when the lock mechanism 41 is in the locked position. In other embodiments, the one or more locking elements may extend from the actuator into the handle 5 without being within a separate housing element.

In some embodiments, the actuator 43 may be rotationally connected to move rotationally between its first and second positions. In other embodiments, the actuator may be linearly moveably connected or otherwise moveably connected to at least one moveable locking element. The motion of the locking element may be linear or rotational as well. In some embodiments, the motion of the locking element may be curvilinear or have another type of motion or path of motion effected via motion of the actuator to which it is connected.

In some embodiments, the locking element adjusted by motion of the actuator 43 can be an element that interacts with at least one spring coupled to the handle to which it is connected to effect a transfer of force from the spring to the handle for locking the position of the handle when the actuator is moved to its first position to move the locking element into its locked position. The one or more locking elements can also be configured to be moved to another position to prevent the spring from transferring a force to the handle when the locking element is moved to its unlocked position via motion of the actuator 43 to its second position. In other embodiments, the locking element may provide a mechanical interlock between the handle and its connection to the second rail 4 or bottom portion of window covering material to lock the position of the handle when the locking element is moved to its locked position and may be moved out of such an interlock position with the handle to permit the handle to move when the locking element is moved to its unlocked position.

It should be understood that in embodiments of the window covering that may use a clutch coupled to a spring within the second rail 4 to help facilitate rolling up of the window covering material during raising of the window covering, the one or more handles may be configured so that they do not have to engage the window covering material or use clips or other mechanism to attach to the window covering material for maintaining a position of the window covering material at a user selected position. Instead, the clutch can be configured to provide a strong enough force to hold the rolled up window covering material at the selected position by not permitting rotation of the second rail when the clutch is moved to position the spring in a disengaged position. In other embodiments in which a spring is positioned in the second rail 4, a clutch may not be present. For such configurations, a lock mechanism may be utilized to lock the position of the spring. In yet other embodiments, clips or the moveable handle that is configured to engage the window covering material to maintain a position of the window covering material may be utilized to help ensure the window covering material stays in a user selected position.

It should be appreciated that embodiments of the window covering and method of making and using the window covering can vary to account for different design objectives. For example, the type of window covering material that is utilized may be any of a desired number of different types of material to provide a desired aesthetic effect and/or a desired insulative property. The material may be sheer, may be light filtering, may be light blocking, or may have other properties as well. As another example, the first rail 3 can be composed of a wood, be an extruded metal rail, or be a polymeric rail and also have any number of different structural shapes and configurations (e.g. an elongated beam, a bar, a rod, etc.). The first rail 3 may have an internal conduit defined therein, may have a channel, or may be a solid structure and have a cross section that is rounded, circular, oval, polygonal, or have another type of shape. In some embodiments, it is contemplated that the first rail 3 may have profiles or connector elements that are configured to receive portions of the clips or a portion of handle 5 so that the handle 5 or clips 7 can be attached to the first rail and extend from the first rail to the rolled up portion of window covering material and/or the second rail 4 when the window covering material is in a fully retracted position, fully raised position, or fully open position. As another example, the second rail 4 can be composed of a wood, be an extruded metal rail, or be a polymeric rail and also have any number of different structural shapes and configurations (e.g. an elongated beam, a bar, a rod, etc.). The second rail 4 may have an internal conduit defined therein, may have a channel, or may be a solid structure and have a cross section that is rounded, circular, oval, polygonal, or have another type of shape. In some embodiments, it is contemplated that the second rail 4 may have profiles or connector elements that are configured to receive portions of the clips or handle so the clips 7 or a portion of handle 5 so that the handle 5 or clips 7 can be attached to the second rail 4 and extend from the second rail 4 to the rolled up portion of window covering material or above that portion of the window covering material when the window covering material is in a fully retracted position, fully raised position, or fully open position (e.g. extend from the second rail 4 to the first rail 3 or from the second rail 4 to a top portion of the window covering material, etc.). The first rail 3 or second rail 4 could have one or more springs coupled therein to help facilitate the raising and/or lowering of window covering material 2. In some embodiments, those one or more springs may be coupled via a clutch or other type of attachment mechanism to permit the one or more springs' ability to provide a biasing force to be engaged and disengaged. Thus, while certain exemplary embodiments of window covering and methods of making and using the same have been shown and described above, it is to be distinctly understood that the invention is not limited thereto but may be otherwise variously embodied and practiced within the scope of the following claims.

What is claimed is:

1. A window covering comprising:

a first rail;

window covering material connected to the first rail such that the window covering material is moveable between a first position and a second position, a first lower portion of the window covering material and a second portion of the window covering material being rolled up when the window covering material is in the second position, a third portion of the window covering material being located above the first and second portions of the window covering material when the window covering material is in the second position;

at least one handle connected to a bottom portion of the window covering material, each handle being moveable between an engaged position in which the handle engages the window covering material and a disengaged position in which the handle disengages the window covering material to permit movement of the window covering material between the first and second positions of the window covering material, each handle configured to contact the window covering material to engage the window covering material to prevent the window covering material from being rolled up about the bottom portion of the window covering material and to prevent the window covering material from being unrolled when in the engaged position, the handle configured to be spaced apart from the window covering material sufficiently to permit the window covering material to be moved between the first and second positions of the window covering material when the handle is in the disengaged position; and wherein the window covering material has loops, rings, or connectors and the handle has one or more hooks or clips configured to connect to the loops, rings or connectors when the handle is in the engaged position.

2. A window covering comprising:

a first rail;

window covering material connected to the first rail such that the window covering material is moveable between a first position and a second position, a first lower portion of the window covering material and a second portion of the window covering material being rolled up when the window covering material is in the second position, a third portion of the window covering material being located above the first and second portions of the window covering material when the window covering material is in the second position;

at least one handle connected to a bottom portion of the window covering material, each handle being moveable between an engaged position in which the handle engages the window covering material and a disengaged position in which the handle disengages the window covering material to permit movement of the window covering material between the first and second positions of the window covering material, each handle configured to contact the window covering material to engage the window covering material to prevent the window covering material from being rolled up about the bottom portion of the window covering material and to prevent the window covering material from being unrolled when in the engaged position, the handle configured to be spaced apart from the window covering material sufficiently to permit the window covering material to be moved between the first and second positions of the window covering material when the handle is in the disengaged position; and wherein the handle is linearly moveable between the engaged and disengaged positions.

3. The window covering of claim 2, wherein the handle is also rotatable between the engaged and disengaged positions.

4. The window covering of claim 2, comprising:

a second rail connected to the bottom portion of the window covering material, the handle moveably connected to the second rail for connection to the bottom portion of the window covering material; and a spring positioned within the second rail.

5. The window covering of claim 2, wherein the window covering material is comprised of fabric, woven wood, bamboo, non-woven fabric, or polymeric material.

6. The window covering of claim 2, wherein the first rail is a headrail.

7. The window covering of claim 2, comprising a bottom rail connected to the bottom portion of the window covering material, the handle moveably connected to the bottom rail for connection to the bottom portion of the window covering material.

8. The window covering of claim 7, wherein the handle has a first end and a second end, the first end rotatably connected to a first end of the bottom rail and the second end rotatably connected to a second end of the bottom rail.

9. A window covering comprising:

a first rail;

window covering material connected to the first rail such that the window covering material is moveable between a first position and a second position, a first lower portion of the window covering material and a second portion of the window covering material being rolled up when the window covering material is in the second position, a third portion of the window covering material being located above the first and second portions of the window covering material when the window covering material is in the second position;

at least one handle connected to a bottom portion of the window covering material, each handle being moveable between an engaged position in which the handle engages the window covering material and a disengaged position in which the handle disengages the window covering material to permit movement of the window covering material between the first and second positions of the window covering material, each handle configured to contact the window covering material to engage the window covering material to prevent the window covering material from being rolled up about the bottom portion of the window covering material and to prevent the window covering material from being unrolled when in the engaged position, the handle configured to be spaced apart from the window covering material sufficiently to permit the window covering material to be moved between the first and second positions of the window covering material when the handle is in the disengaged position;

a bottom rail connected to the bottom portion of the window covering material, the handle moveably connected to the bottom rail for connection to the bottom portion of the window covering material; and wherein the handle has a first end and a second end, the first end slideably connected to a first end of the bottom rail and the second end slidably connected to a second end of the bottom rail.

10. The window covering of claim 9, wherein the handle has a length that extends between the first end of the handle and the second end of the handle, the length of the handle contacting a width of the window covering material when the handle is in the engaged position.

11. A window covering comprising:

a first rail;

window covering material, the window covering material having a top portion connected to the first rail such that the window covering material is moveable between a first position and a second position, a first lower portion of the window covering material and a second portion of the window covering material being rolled up when the window covering material is in the second position, a third portion of the window covering material being located above the first and second portions of the window covering material when the window covering material is in the second position;

a second rail connected to a bottom portion of the window covering material, the second rail having a spring positioned at least partially therein that is adjustable from an engaged position to a disengaged position, the spring connected to the second rail to drive rotation of the second rail to facilitate rolling up of the window covering material about the second rail when the spring is in the engaged position to facilitate moving the window covering material from the first position to the second position;

a handle connected to the second rail, the handle being moveable between a first position of the handle and a second position of the handle, the handle connected to the spring such that movement of the handle to the second position of the handle adjusts the spring from the disengaged position to the engaged position and movement of the handle from the second position of the handle to the first position of the handle adjusts the spring from the engaged position to the disengaged position;

wherein the first, second, and third portions of the window covering material are between the top portion of the window covering material and the bottom portion of the window covering material; and a plurality of clips connected to the handle, the clips configured to extend from the handle to releaseably connect to the window covering material to maintain the window covering material in the second position when the clips are connected to the window covering material and to permit adjustment of the window covering material when the clips are disconnected from the window covering material.

12. The window covering of claim 11, wherein the window covering material has connectors, the clips being releaseably connectable to the connectors to be releasably connected to the window covering material.

13. A window covering comprising:

a first rail;

window covering material, the window covering material having a top portion connected to the first rail such that the window covering material is moveable between a first position and a second position, a first lower portion of the window covering material and a second portion of the window covering material being rolled up when the window covering material is in the second position, a third portion of the window covering material being located above the first and second portions of the window covering material when the window covering material is in the second position;

a second rail connected to a bottom portion of the window covering material, the second rail having a spring positioned at least partially therein that is adjustable from an engaged position to a disengaged position, the spring connected to the second rail to drive rotation of the second rail to facilitate rolling up of the window covering material about the second rail when the spring is in the engaged position to facilitate moving the window covering material from the first position to the second position; and a first handle connected to a first end of the second rail, the first handle being moveable between a first position and a second position, the first handle connected to the spring such that movement of the first handle to the second position of the first handle adjusts the spring from the disengaged position to the engaged position and movement of the first handle from the second position of the first handle to the first position of the first handle adjusts the spring from the engaged position to the disengaged position;

a second handle connected to a second end of the second rail that is opposite the first end of the second rail, the second handle being moveable between a first position and a second position, the second handle connected to the spring such that movement of the second handle to the second position of the second handle adjusts the spring from the disengaged position to the engaged position and movement of the second handle from the second position of the second handle to the first position of the second handle adjusts the spring from the engaged position to the disengaged position; and wherein the first, second, and third portions of the window covering material are between the top portion of the window covering material and the bottom portion of the window covering material.

14. The window covering of claim 13, wherein the first lower portion of the window covering material is between the bottom portion of the window covering material and the second portion of the window covering material when the window covering material is in the first position of the window covering material, the first lower portion of the window covering material and the second portion of the window covering material being unrolled when the window covering material is in the first position of the window covering material.

15. The window covering of claim 14, wherein the window covering material has loops, rings, or connectors and the first handle has at least one hook or at least one clip configured for releaseable connection to the loops, rings or connectors.

16. The window covering of claim 14, comprising:

a clutch positioned within the second rail, the clutch connected to the spring.

17. A window covering comprising:

a first rail;

window covering material, the window covering material having a top portion connected to the first rail such that the window covering material is moveable between a first position and a second position, a first lower portion of the window covering material and a second portion of the window covering material being rolled up when the window covering material is in the second position, a third portion of the window covering material being located above the first and second portions of the window covering material when the window covering material is in the second position;

a first column of connectors connected to the window covering material;

a second rail connected to a bottom portion of the window covering material;

a first handle connected to a first end of the second rail, the first handle being moveable between a first position and a second position, a portion of the first handle configured to be releaseably connected to the window covering material via a connector of the first column of connectors when the first handle is in the first position of the first handle to help maintain a position of the window covering material, the portion of the first handle being separated from the connector of the first column of connectors when the first handle is in the second position of the first handle to facilitate adjustment of the window covering material.

18. The window covering of claim 17, comprising:

a second column of connectors connected to the window covering material;

a second handle connected to a second end of the second rail that is opposite the first end of the second rail, the second handle being moveable between a first position and a second position, a portion of the second handle configured to be releaseably connected to the window covering material via a connector of the second column of connectors when the second handle is in the first position of the second handle to help maintain a position of the window covering material, the portion of the second handle being separated from the connector of the second column of connectors when the second handle is in the second position of the second handle to facilitate adjustment of the window covering material.

19. The window covering of claim 17, comprising:

a spring positioned within the second rail, the spring being actuatable between an engaged position and a disengaged position, the spring biasing rotation of the second rail when the spring is in the engaged position.

20. The window covering of claim 19, wherein the first handle is configured to actuate adjustment of the spring from the disengaged position to the engaged position when the first handle is moved from the first position of the first handle to the second position of the first handle.

* * * * *